United States Patent [19]

Toyama et al.

[11] 4,365,609

[45] Dec. 28, 1982

[54] DISTRIBUTOR ASSEMBLY HAVING AN IGNITION COIL THEREIN

[75] Inventors: Kouichi Toyama, Kariya; Yasushi Sugiura, Chiryu; Michio Adachi, Kariya, all of Japan

[73] Assignee: Nippondenso Co., Ltd., Kariya, Japan

[21] Appl. No.: 225,530

[22] Filed: Jan. 16, 1981

[30] Foreign Application Priority Data

Jan. 23, 1980 [JP] Japan ..... 55-7255
Jan. 23, 1980 [JP] Japan ..... 55-7256

[51] Int. Cl.[3] ..... F02P 1/00

[52] U.S. Cl. ..... 123/635; 123/617; 123/647; 123/645

[58] Field of Search ..... 123/617, 645, 647, 634, 123/635, 146.5 A

[56] References Cited

U.S. PATENT DOCUMENTS

| | | | |
|---|---|---|---|
| 1,277,388 | 9/1918 | Conrad | 123/647 |
| 3,328,614 | 6/1967 | Falge et al. | |
| 3,744,466 | 7/1973 | Brammer et al. | 123/617 |
| 3,888,225 | 6/1975 | Boyer et al. | 123/617 |
| 4,129,107 | 12/1978 | Boyer . | |

FOREIGN PATENT DOCUMENTS

| | | | |
|---|---|---|---|
| 33136 | 8/1981 | European Pat. Off. | 123/617 |
| 2825398 | 12/1978 | Fed. Rep. of Germany | 123/146.5 A |
| 2432096 | 3/1980 | France | 123/635 |
| 54-121912 | 9/1979 | Japan | 123/617 |
| 51885 | 9/1941 | Netherlands | 123/635 |

*Primary Examiner*—P. S. Lall
*Attorney, Agent, or Firm*—Cushman, Darby & Cushman

[57] ABSTRACT

In a distributor assembly having an ignition coil therein, for use with an internal combustion engine, the positional relationship between the ignition coil and a magnetic sensitive detector, which detects a proper ignition timing, is selected so that the leakage flux from the ignition coil does not cause the magnetic sensitive detector to malfunction. According to one arrangement the magnetic sensitive direction of the detector is arranged perpendicular to the leakage flux from the ignition coil. According to the other arrangement the magnetic sensitive direction of the detector is arranged to intersect a radial line from the axis of the main magnetic flux of the ignition coil at an angle other than 90 degrees so that the flux variation in the detector is expedited by the appearance and disappearance of the leakage flux. In the both arrangements, the axis is arranged parallel to a rotary shaft to which a signal rotor is attached, where the rotation of the signal rotor is arranged to cause the detector to change its output signal by detecting the variation in magnetic flux.

12 Claims, 21 Drawing Figures

FIG. 1 PRIOR ART
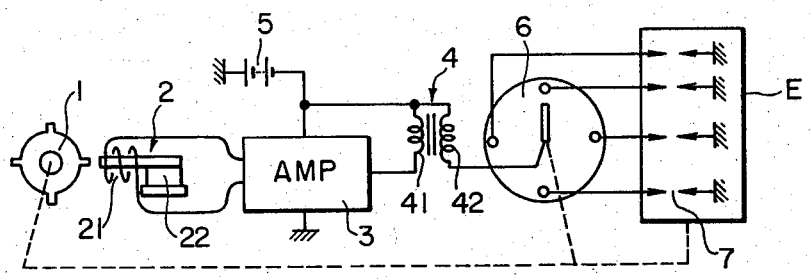
FIG. 2(a)
FIG. 2(b)
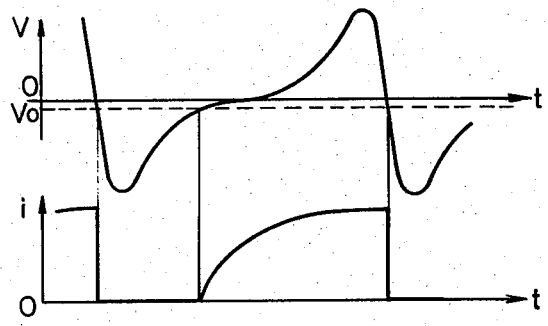
FIG. 3 PRIOR ART
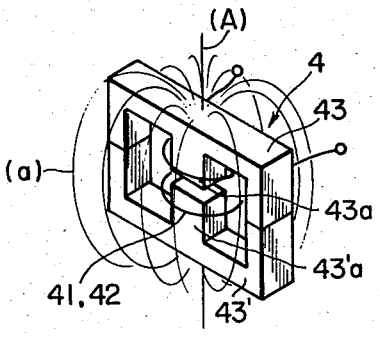

FIG. 4($a_1$)
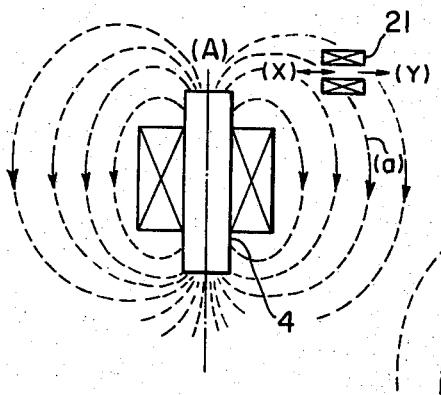
FIG. 4($a_2$)
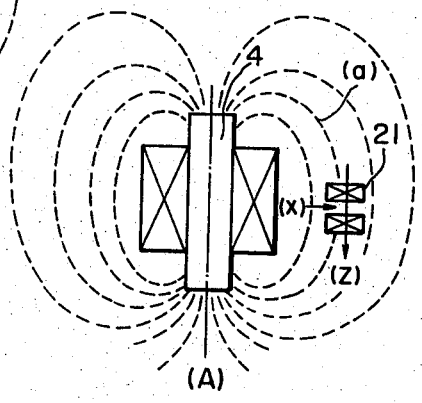
FIG. 4($b_1$)
FIG. 4($c_1$)
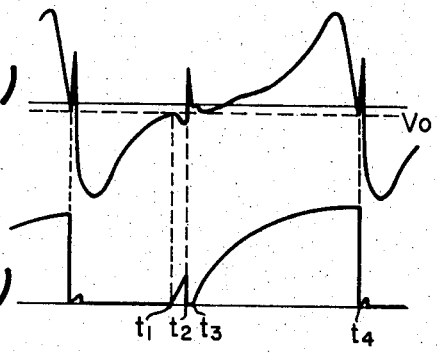
FIG. 4($b_2$)
FIG. 4($c_2$)
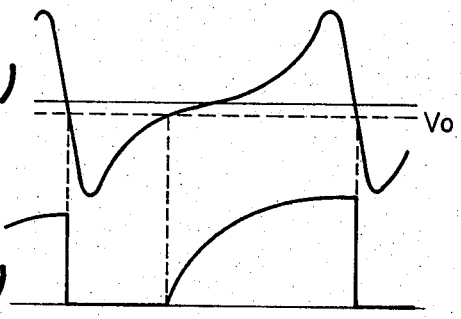

FIG. 5($a_1$)
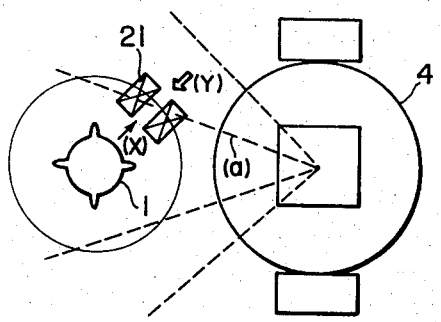
FIG. 5($a_2$)
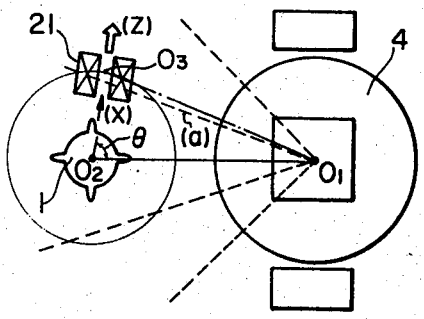
FIG. 5($b_1$)
FIG. 5($c_1$)
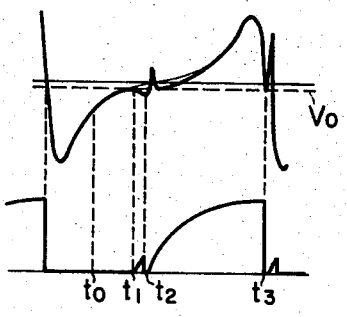
FIG. 5($b_2$)
FIG. 5($c_2$)
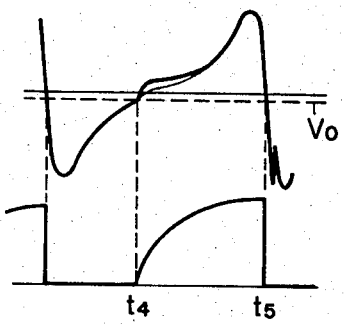
FIG. 5($b_3$)
FIG. 5($c_3$)
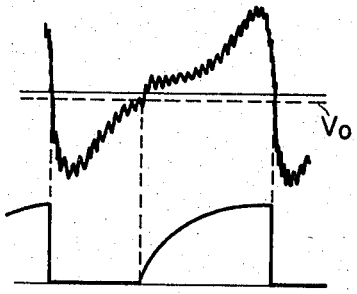

DISTRIBUTOR ASSEMBLY HAVING AN IGNITION COIL THEREIN

FIELD OF THE INVENTION

This invention generally relates to a distributor assembly for use with an ignition system of an internal combustion engine of a motor vehicle or the like. More particularly, the present invention relates to a distributor assembly having an ignition coil therein.

BACKGROUND OF THE INVENTION

Ignition devices for internal combustion engines of vehicles are recently required to have a higher suitability in installing on a vehicle and a higher reliability in electrical connection between parts.

The present invention is to provide, in response to the above-mentioned requirements, an ignition device of a single unit having an ignition distributor and an ignition coil. The invention aims, in combining an ignition coil, to prevent the ignition device from malfunctioning by preventing the leakage flux of the ignition coil from being an undesirable influence on a magnetism-sensitive rotation signal generating means (for instance, an electromagnetic pickup using a permanent magnet and a coil) which is built in the ignition distributor.

As will be described hereinlater, when an ignition coil is incorporated in a single unit of a distributor assembly, the leakage flux from the ignition coil is apt to affect rotation signal generating means, such as an electromagnetic pick up, which is arranged to produce a triggering signal by detecting the rotation of the engine crakshaft where the triggering signal will be used to control the energization of the primary winding of the ignition coil. Namely, when the rotation signal generating means is of an electromagnetic type, a noise voltage may be induced due to the leakage flux from the ignition coil resulting in false triggering of the ignition coil. As a result, the ignition system malfunctions, and thus proper ignition timing is deteriorated.

SUMMARY OF THE INVENTION

The present invention has been achieved in order to remove the above-described disadvantage and drawback inherent to the conventional distributor assembly having an ignition coil therein.

It is, therefore, an object of the present invention to provide a new and useful distributor assembly having an ignition coil, in which malfunction, such as false triggering, due to the leakage flux from the ignition coil is effectively prevented.

A feature of the present invention is to provide a distributor assembly having an ignition coil, in which the leakage flux from the ignition coil is effectively used to prevent undesirable influence of external noises.

In accordance with a first feature of the present invention the ignition coil is arranged in such a manner that a plane perpendicular to the axis of the main magnetic flux generated by the energization of the primary winding is substantially parallel to the magnetic sensitive direction of a rotational signal generating means, and the axis is parallel to the rotary shaft of the distributor to which a signal rotor is attached where the signal rotor is arranged to cause the rotation signal generating means to emit an output signal which will be used to control the energization of the ignition coil, while the rotation signal generating means is arranged at a substantially midway point of an external magnetic path of a magnetic flux passing through the axis of the main magnetic flux within the core of the ignition coil.

In accordance with a second feature of the present invention the ignition coil is arranged in such a manner that the axis of the main magnetic flux made by the energization of the primary winding is substantially parallel to the rotary shaft of the distributor, while a rotation signal generating means is arranged in such a position that the magnetic sensitive direction thereof intersects a radial line from the axis of the main magnetic flux of the ignition coil at an angle other than 90 degrees so that appearance of a leakage flux of the ignition coil acts on the rotation signal generating means, which is caused by the rotation of a signal rotor attached to the rotary shaft, and disappearance of the leakage flux acts on the rotation signal generating means reducing a decreasing flux in the rotation signal generating means, which is caused by the rotation of the signal rotor.

BRIEF DESCRIPTION OF THE DRAWINGS

The object and these and other features of the present invention will become more readily apparent from the following detailed description of the preferred embodiment taken in conjunction with the accompanying drawings in which:

FIG. 1 is a circuit diagram of an ignition device to which the present invention is adapted;

FIGS. 2 (*a*) and (*b*) are waveform charts for the description of the operation;

FIG. 3 is a schematic view of an example of an ignition coil used in the present invention;

FIGS. 4 ($a_1$) and ($a_2$) are schematic views showing two examples of positional relationship between the rotation signal generating means and the ignition coil;

FIGS. 4 ($b_1$) and ($c_1$) are waveform charts in case of FIG. 4 ($a_1$);

FIGS. 4 ($b_2$) and ($c_2$) are waveform charts in case of FIG. 4 ($a_2$);

FIGS. 5 ($a_1$) and ($a_2$) are schematic views of another two examples of positional relationship between the rotation signal generating means and the ignition coil;

FIGS. 5 ($b_1$) and ($c_1$) are waveform charts in case of FIG. 5 ($a_1$);

FIGS. 5 ($b_2$) and ($c_2$) are waveform charts in case of FIG. 5 ($a_2$);

DETAILED DESCRIPTION OF THE INVENTION

Figure 6A:
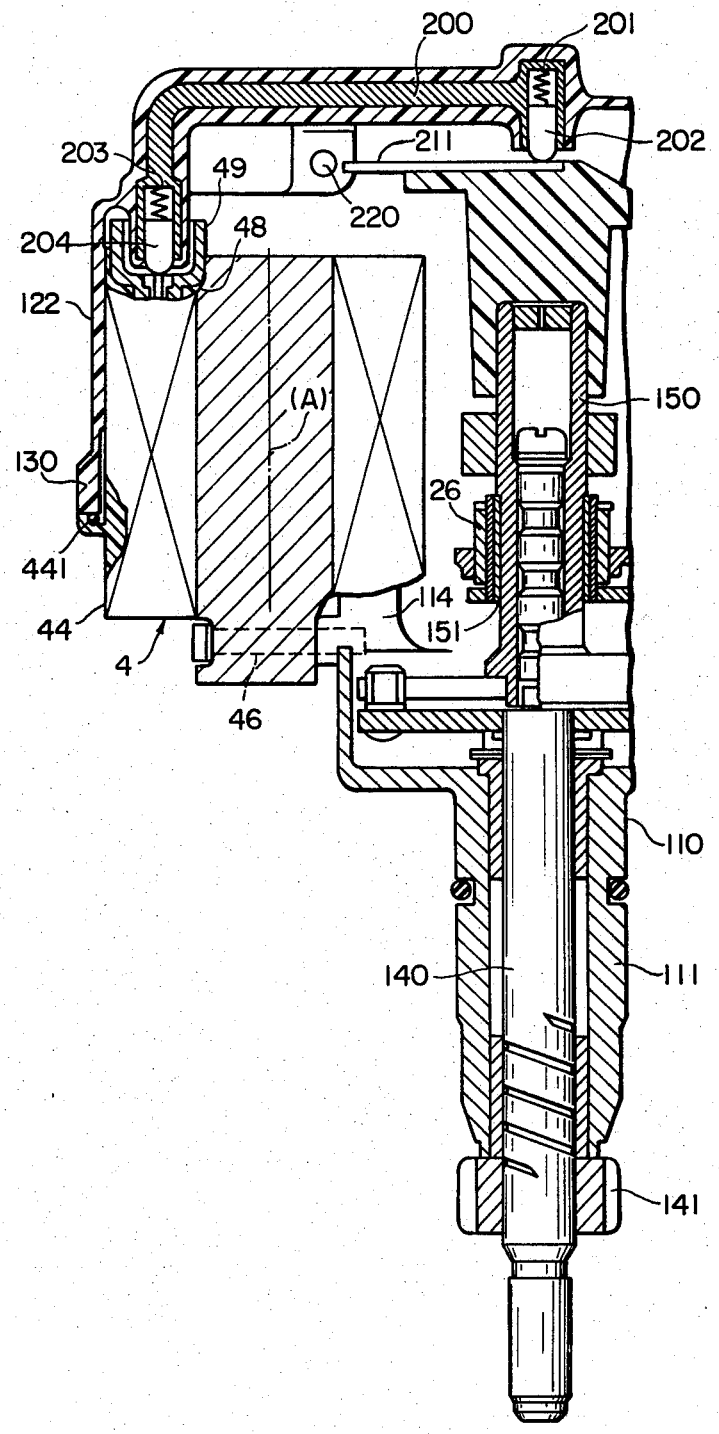
FIGS. 6A and 6B are cross-sectional views of an embodiment of the distributor assembly according to the present invention, which views are respectively taken along the lines VI—VI and VI'—VI' of FIG. 7.

FIG. 1 shows a general ignition device or system to which the present invention is adapted.

In this ignition device, a signal rotor 1 having the same number of projections as the number of cylinders of an engine E is rotated by the engine E in proportion to the rotational speed thereof. Namely, the signal rotor 1 rotates in synchronism with the engine crankshaft. An electromagnetic pickup 2 comprising a pickup coil 21 and a permanent magnet 22 is arranged to face the signal rotor 1, and an output signal is developed across the coil 21 of the pickup 2 by the variation of magnetic flux due to the rotation of the signal rotor 1. An ignition amplifier 3 controls the intermittent energization of a primary winding 41 of an ignition coil 4 by selectively applying a current from a battery 5 in accordance with the output signal of the electromagnetic pickup 2.

Assuming that the signal rotor 1 rotates from a state where one of the projections of the signal rotor 1 faces the pickup 2 until a next projection faces the same, the magnetic flux which passes through the pickup coil 21 varies so that an output signal voltage as shown by a solid line waveform in FIG. 2 (*a*) is developed across the pickup coil 21. The above-mentioned ignition amplifier 3 detects the waveform of this output signal on the basis of a constant detecting level $V_0$, which is shown by a broken line, and controls in such a manner, for instance, when the signal voltage is greater than the detecting level $V_0$, the primary winding 41 of the ignition coil 4 is energized, and on the other hand, when smaller, the same is deenergized. Accordingly, the current flowing through the primary winding 41 of the ignition coil 4 is controlled as shown in FIG. 2 (*b*). In FIGS. 2 (*a*) and (*b*), the ordinates respectively indicate voltage V and current i, while the abscissa indicate time t.

In the ignition coil 4, when the energization of the primary winding 41 is interrupted, a high voltage is induced across a secondary winding 42. This high voltage is distributed by a distributor 6 to be applied to respective spark plugs 7 of respective cylinders of the engine E. Thus, ignition in the engine E is performed.

In the above-mentioned ignition device, the usual arrangement is such that the signal rotor 1 is attached to the rotary shaft of the distributor 6, while the electromagnetic pickup 2 is disposed in the housing of the distributor 6 to face the signal rotor 1 so as to be sensitive to the flux variation in the radial direction of the signal rotor 1. According to recent tendency the ignition amplifier 3 is also arranged inside the distributor 6.

When an ignition coil is assembled with the ignition distributor 6, in which the electromagnetic pickup 2 is built in, in the above-described manner, there is a tendency for leakage flux from the ignition coil to induce noise voltages in the electromagnetic pickup.

The noise voltage is in proportion to the variation rate of the leakage flux of the ignition coil 4, and will be superimposed on the original output signal waveform of the electromagnetic pickup 2 caused by the signal rotor 1, and therefore, it is predicted with high possibility that undesirable influences are given to the ignition amplifier and therefore, to the operation of the entire system of the ignition device.

FIG. 3 is a view showing the principle of a general ignition coil of closed magnetic path type, in which a pair of symmetric E-shaped iron cores 43 and 43' are arranged to face each other, and primary and secondary windings 41 and 42 are wound around the center leg portions 43*a* and 43'*a* thereof. In the ignition coil of this type, an axis (A) of a main magnetic flux passes through the center leg portions 43*a* and 43'*a* when the primary winding 41 is energized. Although the ignition coil 4 is of closed magnetic path type, there exists a leakage flux from the magnetic circuit as is well known, and the leakage flux (a) is radially emitted from a substantial center of one E-shaped core 43, and then converges to a substantial center of the opposite E-shaped core 43'. Therefore, if the ignition coil 4 is arranged in a single unit with the electromagnetic pickup in a limited space of a distributor assembly, the coil of the electromagnetic pickup 2 is forced to be arranged in such a manner that the leakage flux (a) passes therethrough. As a result, it is a matter of course that a noise voltage is developed across the coil of the electromagnetic pickup 2 owing to the leakage flux (a).

Let it be assumed that the coil 21 of the electromagnetic pickup 2 and the ignition coil 4 are arranged as shown in FIG. 4 ($a_1$), and the influence by the leakage flux will be analyzed. FIG. 4 ($a_1$) shows the ignition coil 4 in cross-section taken along the axis (A) of the main magnetic flux generated by the current through the primary winding 41 thereof. It is assumed that the magnetic sensitive dirrection of the pickup coil 21 is the direction of an arrow (X) which indicates the longitudinal axis of pickup coil 21, while the direction of the leakage flux (a) of the ignition coil 4 is the direction from the top end toward the bottom end of the main magnetic flux path.

In this case, the leakage flux (a), which is radially emitted from the ignition coil 4 as shown by broken lines in FIG. 4 ($a_1$), also passes in the same direction indicated by the arrow (Y) as the magnetic sinsitive direction of the pickup coil 21. As a result, a noise voltage due to the leakage flux (a) is superimposed on the pickup coil 21, and the waveform of the output signal voltage of the pickup coil 21 is as shown in FIG. 4 ($b_1$), while the energization characteristic of the primary winding 41 of the ignition coil 4 is as shown in FIG. 4 ($c_1$).

Namely, when the output waveform of the pickup coil 21 exceeds the detecting level $V_0$ of the ignition amplifier (see FIG. 1) at time $t_1$, a primary winding current starts flowing, and simultaneously leakage flux (a) occurs to cause the piciup coil 21 to generate a noise voltage, for instance, of negative polarity, and when this noise voltage becomes below a hysterisis voltage of the ignition amplifier at time $t_2$, the current to the primary winding 41 of the ignition coil 4 is interrupted. With this interruption a positive noise voltage, which is opposite to that described in the above, is superimposed on the pickup coil 21 resulting in the reenergization of the primary winding 41 of the ignition coil 4 at time $t_3$. With the pickup coil 21 reenergized, a negative noise voltage is again superimposed on the output signal thereof, but the fundamental output of the pickup coil is so sufficiently positive at this time that the negative noise voltage does not affect. Furthermore, at time $t_4$, which is the proper ignition timing, the energization of the primary winding 41 of the ignition coil 4 is interrupted, and a positive noise voltage is superimposed on the waveform of the output of the piciup coil 21 with this interruption, thus energization of the primary winding 41 of the ignition coil 4 is performed for a very short period of time.

Consequently, malfunction, such as false triggering, of the ignition amplifier 3 is apt to occur with the positional relationship between the pickup 2 and the ignition coil 4 shown in FIG. 4 ($a_1$). The cause of malfunction resides in the arrangement of the pickup coil 21, which is located in the vicinity of the top end portion of the main magnetic flux path of the ignition coil 4.

Now let us assume a case that the pickup coil 21 is arranged at a substantially midway point of an external magnetic path of the main magnetic flux passing through the axis (A) of the main magnetic flux within the core of the ignition coil 4, where the magnetic sensitive direction (X) thereof is arranged to be parallel to a plane which is perpendicular to the main magnetic flux axis (A) of the ignition coil 4. In this case, the leakage flux (a) passes through the pickup coil 21 in the arrow direction (Z) perpendicular to the magnetic sensitive direction thereof (X), so that no noise voltage can be superimposed on the output waveform of the pickup coil 21 as shown in FIG. 4 ($b_2$). Therefore, the waveform of the current flowing through the primary winding 41 of the ignition coil 4 is as shown in FIG. 4 ($c_2$), preventing the ignition amplifier 3 from malfunctioning.

Apart, from the arrangements of FIGS. 4 ($a_1$) and ($a_2$), let it be assumed that the signal rotor 1, the coil 21 of the electromagnetic pickup 2, and the ignition coil 4 have positional relationship as shown in FIG. 5 ($a_1$) while direction of the magnetic flux from the permanent magnet 22 (see FIG. 1) of the electromagnetic pickup 2 passing through the coil 21 is the direction of an arrow (X) facing outwardly from the signal rotor 1, and also the leakage flux (a) from the ignition coil 4 converges from the front side to the back side of the drawing, and the influence by the leakage flux (a) will be analyzed. In this case, the leakage flux (a), which is shown by broken lines, from the ignition coil 4 passes through the coil 21 of the electromagnetic piciup 2 in a direction (Y) which is opposite to the above-mentioned passing direction (X) of the magnetic flux from the permanent magnet. As a result, the waveform of the output signal voltage of the pickup coil 21 is as shown in FIG. 5 ($b_1$), and the condition of energization of the primary winding of the ignition coil 4 is as shown in FIG. 5 ($c_1$). Namely, at time $t_0$ the signal level is negative, and therefore, energization of the ignition coil 4 is not made, and at time $t_1$ at which it is more positive than the detection level $V_0$, the primary winding 41 of the ignition coil 4 is energized, and simultaneously leakage flux (a) from the ignition coil 4 occurs causing the output waveform of the pickup coil 21 to generate a noise voltage, where the polarity thereof is negative. As a result, at time $t_2$ it is below the detection level $V_0$ by a given amount, and thus the energization of the ignition coil 4 terminates. As a result of this operation, a positive noise voltage, which is opposite to the above, occurs in the output waveform of the pickup coil 21 due to disappearance of the leakage flux (a), and thus reenergization of the ignition coil 4 is performed. Although a negative voltage is again superimposed on the output waveform of the pickup coil 21, the energization of the ignition coil 4 is maintained since the level has been already more positive than the detection level $V_0$. Then at time $t_3$ the signal voltage of the pickup coil 21 suddenly drops to be below the detection level $V_0$, and thus the energization of the ignition coil 4 terminates at this time. Simultaneously a positive noise voltage is superimposed on the output waveform of the pickup coil 21, as shown in the drawing, because the variation (disappearance) of the magnetic flux of the ignition coil 4, and thus the ignition coil 4 is energized for a given short period of time. As a result, with the arrangement of FIG. 5 ($a_1$) malfunction due to leakage flux exists.

Now let us assume that the position of the electromagnetic pickup 2 is changed to a position shown in FIG. 5 ($a_2$) by rotating the same about the signal rotor 1 in the direction that it goes far from the ignition coil 4. In this case, the leakage flux (a), which is shown by broken lines, from the ignition coil 4 passes through the pickup coil 21 in the direction of an arrow (Z) which is the same as the direction of the arrow (X); namely the leakage flux (a) passing direction is opposite to that in case of FIG. 5 ($a_1$). Accordingly, there will be difference in the signal voltage waveform shown in FIG. 5 ($b_2$) and in the current waveform, shown in FIG. 5 ($c_2$) of the ignition coil 4. Namely, the polarlity of the noise voltage in this case is opposite to the above-described case, and therefore, there will be no problem because the noise voltage is superimposed at the positive side of the output waveform of the pickup coil at the time of initialization (time $t_4$) of the energization of the ignition coil 4. Furthermore, when energization of the ignition coil 4 is interrupted at time $t_5$, a negative noise voltage is superimposed on the contrary, and thus no problem will occur. From the foregoing, it is realized that when incorporating an ignition coil and an electromagnetic pickup in a distributor, care must be taken in connection with the relative position between the ignition coil and the electromagnetic pickup in such a way that the noise voltage due to the leakage flux (a) of the ignition coil 4 has a polarity such that the variation tendency of the output waveform is expedited. In detail, in case of the arrangement described in connection with FIG. 5 ($a_2$), assuming that the distance between the center $O_1$ of the ignition coil 4 of closed magnetic path type, that is the starting and ending point of the leakage flux (a), and the center $O_2$ of the signal rotor 1 is l; the distance between the center $O_2$ of the signal rotor 1 and the center $O_3$ of the coil 21 of the electromagnetic pickup 2 is r; and the angle between the line $O_1O_2$ and the other line $O_2O_3$ is $\theta$, the following relationship should be satisfied:

$$\theta \geqq \cos^{-1}(l/r) \quad (1)$$

The above condition will be reversed if the direction of the energization of the primary coil of the ignition coil 4 is changed. This is also the same when the polarity of the permanent magnet of the electromagnetic pickup 2 is reversed. Accordingly, the polarity must be such that the noise voltage due to the leakage flux from the ignition coil expedites the variation tendency of the output waveform of the pickup coil 2.

Figure 6B:
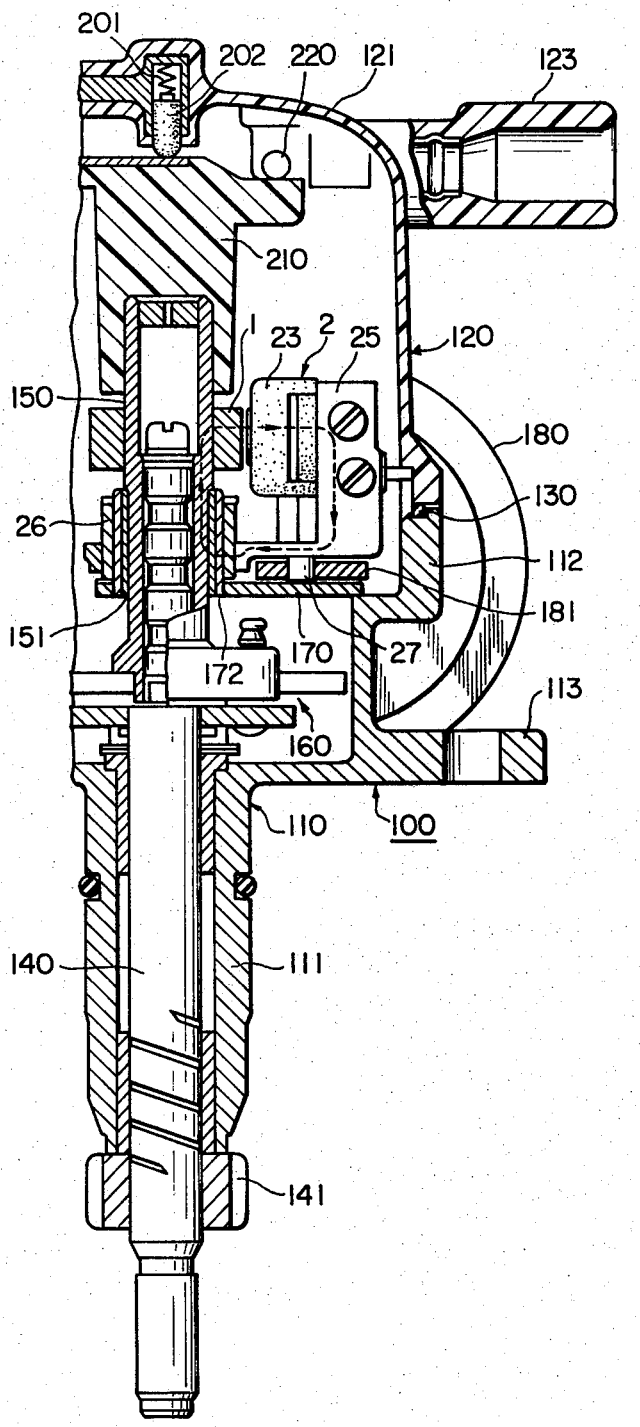
Figure 7:
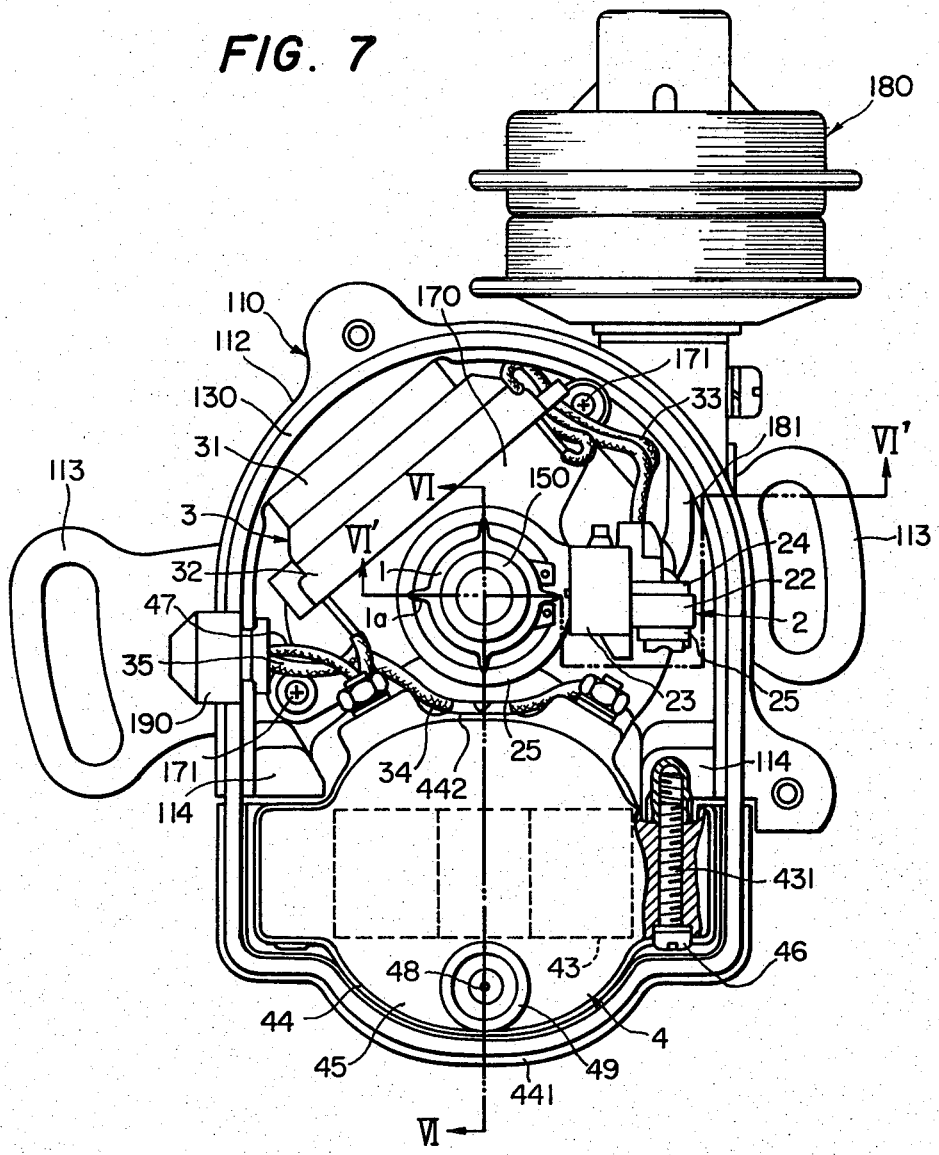
FIG. 7 is a top plan view of the distributor assembly shown in FIGS. 6A and 6B, from which distributor assembly the cap thereof is taken away.

FIGS. 6A and 6B and FIG. 7 show an actual structure of the single-unit distributor having an ignition coil as an embodiment of the present invention, in which the relationship shown in FIG. 4 ($a_2$) and/or FIG. 5 ($a_2$) has been actualized. In FIGS. 6A, 6B and 7, the same elements as in FIGS. 1 to 4 are designated at like numerals.

In FIGS. 6A, 6B and 7, a distributor body 100 comprises a distributor housing 110 and a cap 120. The housing 110 comprises a first cylinder portion 111 and a second cylinder portion 113 connected to top end of the former, where the diameter of the latter is greater than the latter. The cap 120 comprises a distributor cap portion 121 which covers the second cylinder portion 112, and an ignition coil cap portion 122 which covers an ignition coil described hereinlater, where the latter is arranged at one side of the former. The cap 120 is fastened by means of unshown screws to the top end of the second cylinder portion 112 of the housing 110. Between the housing 110 and the cap 120 interposed is a seal ring 130 for sealing the abutting portion therebetween. Flanges 113 are formed at two places on the housing 110, which flanges will be used to support the distributor to a supporting portion of an unshown internal combustion engine.

A rotary shaft 140 is inserted in the first cylinder portion 111 of the housing 110, and the top end thereof is located at the inside of the second cylinder portion 112. The top end of the same is telescopically engaged with a cylindrical distributor shaft 150, and the distributor shaft 150 and the rotary shaft 140 are linked by means of a well known centrifugal advance mechanism 160. The rotary shaft 140 comprises at its bottom end a gear 141 so as to be linked with the unshown internal combustion engine, and thus the rotary shaft 140 is rotated in proportion to the rotational speed of the internal combustion engine. The distributor shaft 150 rotates with an angle which has been advanced with respect to the rotary shaft 140 by a value corresponding to the rotational speed of the engine because of the operation of the centrifugal advance mechanism 160.

Inside the second cylinder portion 112 of the housing 110, a plate 170 is fixed by means of a screw 171 above the centrifugal advance mechanism 160. A cylindrical supporting member 172 coupled with the plate 170, and the distributor shaft 150 penetrates the inside thereof, and is supported via an annular bearing 151 by the supporting member 172.

A signal rotor 1 is fixedly attached to the distributor shaft 150 above the supporting member 172, and an electromagnetic pickup 2, which serves as a rotation signal generating means, is placed in the distributor body 100, facing to the signal rotor 1. As described in the above, the signal rotor 1 has projecteions 1*a* the number of which equals the number of the cylinders of the internal combustion engine; the number is four in this embodiment, and the rotation of the projections 1*a* will cause the magnetic flux passing through the electromagnetic pickup 2 to change. The electromagnetic pickup 2 has a structure such that the coil 21 thereof (see FIG. 1) is embedded in a coil portion 23 made of a mold of a synthetic resin, where the coil portion 23 is supported by a first bracket, and a permanent magnet 22 is interposed between the first bracket and a second bracket 25. The second bracket 25 is rotatably supported by means of a bearing 26 at the periphery of the supporting member 172, thereby the entire pickup 2 is also held. The magnetic flux from the permanent magnet 22 passes through a magnetic circuit (see a broken line in FIG. 6B) constructed of the second bracket 25, bearing 26, distributor shaft 150, signal rotor 1 and the first bracket 24, so as to pass through the pickup coil 21 in the coil portion 23. The pickup coil 21 has its magnetic sensitive direction in the radius direction of the signal rotor 1, and the magnetic flux varies as the signal rotor 1 rotates so that a rotation signal voltage will be developed across the pickup coil 21 as described in the above.

The above-mentioned second bracket 25 of the pickup 2 is provided with a pin 27, and a rod 181 of a well known vacuum advance mechanism 180, which is mounted on the housing 11, is linked with the pin 27. Accordingly, the pickup 2 is rotated with respect to the supporting member 172 (and therefore the signal rotor 1) by the operation of the vacuum advance mechanism 180 which is operatively coupled to the intake manifold of the engine. It is well known that the ignition timing changes because of the rotation of the pickup 2 and also because of the above-mentioned rotation of the distributor shaft 150 (signal rotor 1) with respect to the rotary shaft 140.

The ignition coil 4 has a structure such that a pair of iron cores of closed magnetic path type as shown in FIG. 3, and primary and secondary windings incorporated therein are all contained in a case 44 made of a synthetic resin, where the inside of the case 44 is filled with a mold made of a synthetic resin 45. A section of the second cylinder portion 112 of the housing 110 is cut off to install the ignition coil 4, where posts 114 are provided at both sides of the ignition coil 4. The ignition coil 4 is fixedly supported at the posts 114 by means of installing bolts 46 fitted in installing holes 431 of the iron core 43. Four installing bolts in total, namely two for each post 114, are used.

The ignition coil 4 is fixed at one side of the second cylinder portion 112 of the housing 110 as described in the above, in such a manner that the main magnetic flux axis (A) occuring on energization of the primary winding is parallel to the axis of the rotary shaft 140. As the ignition coil 4 is fixed at one side of the housing 110 in this way, the center of gravity of the entire distributor is lower than a portion of the distributor at which the distributor assembly is fixed to the engine, and thus it is advantageous in connection with vibration-proof characteristic. Furthermore, the positional relationship between the ignition coil 4 and the above-mentioned electromagnetic pickup 2 is selected to be the relation described with reference to FIG. 4 ($a_2$) and/or FIG. 5 ($a_2$), and thus undesirable influence of the leakage flux from the ignition coil 4 is not exerted upon the pickup 2. Especially in case of FIG. 5 ($a_2$), the above-mentioned formula (1) is satisfied. As a result, the leakage flux from the ignition coil 4 has a polarity such that the variation tendency of the output signal of the pickup is expedited, utilizing the leakage flux effectively.

As described in the above, the electromagnetic pickup 2 is rotated about the signal rotor 1 by the operation of the vacuum advance mechanism 180 in order to control the ignition timing, and in this case it is a matter of course that the pickup 2 is rotated with the above-mentioned positional relationsnip represented by FIG. 4 ($a_2$) and/or FIG. 5 ($a_2$) with respect to the ignition coil 4.

On the side of the case 44 of the ignition coil 4 formed is a flange 441 which meets the upper surface of the housing 110, and this flange 441 abuts against the coil cap portion 122 of the cap 120 via the abovementioned seal ring 130. Accordingly, the ignition coil 4 is covered by the cap 120.

On the inside wall of the second cylinder portion 112 of the housing, the ignition amplifier 3 shown in FIG. 1 is fixed by menas of suitable means such as unshown screws. The amplifier 3 has a structure such that electronic elements are arranged in a metallic case 31 which also serves as a radiator, and the amplifier 3 is covered by a case 32 made of a synthetic resin. The amplifier 3 is connected respectively to the pickup 2 and to the ignition coil 4 by leads 33 and 34. The lead connecting the amplifier 3 to the ignition coil 34 is supported by a clamp 442 which is integrally formed with the case 44 of the ignition coil 4, and thus care is taken not to interfere the signal rotor 1. Leads 35 and 47 from the amplifier 3 and the ignition coil 4 are drawn outside via a grommet 190 attached to the housing 110 so as to be connected to the battery 5 (see FIG. 1).

At the top center of the distributor cap 121 of the cap 120 disposed is one end of a center electrode 200, where a brush 202 biased by a spring 202 is also disposed. To the upper end of the above-mentioned distributor 150 attached is a distributor rotor 210, and a rotor electrode 211 is fixed to the upper surface of the distributor rotor 210. The brush 202 is in contact with the rotor electrode 211. The center electrode 200 extends to the ignition coil cap portion 122, and the other end is placed above the ignition coil 4, where a brush 204 biased by a spring 203 is also disposed. A high tension terminal 48 connected to the secondary winding is provided to the ignition coil 4 so as to correspond to the brush 204, where a cylindrical tower portion 49 is integrally formed with the case 44 to surround the same. The brush 204 is in contact with this high tension terminal 48. Thus, the high voltage from the ignition coil 4 is applied to the center electrode 200, and is led therethrough to the rotor electrode 211. The connection between the center electrode 200 and the ignition coil 4 is completed by simply placing the cap 120 on the housing 110.

Around the top of the distributor cap 121 of the cap 120 provided are side electrodes 220 the number of which is the same as the number of the cylinders of the engine; in this embodiment the number is four. The side electrodes 220 are led to a tower portion 123 which projects toward the side of the cap 120. The rotor electrode 211 faces the side electrodes one after another by the rotation of the distributor rotor 210, distributing high voltage. The distributed high voltages are led to spark plugs 7 (see FIG. 1) which are connected via high tension codes connected to the tower portion 123.

From the foregoing, it will be understood that according to the present invention one or both of the positional relationships between the ignition coil 4 and the rotation signal generating means 2 respectively described with reference to FIG. 4 ($a_2$) and FIG. 5 ($a_2$) is/are adopted, and thus malfunction of the ignition system is effectively prevented. Especially, when the positional relationship of FIG. 5 ($a_2$) is adopted, the increasing flux in the pickup 2 due to the rotation of the signal rotor 150 is enriched by the leakage flux from the ignition coil 4, and then the decreasing flux in the same is reduced by the disappearance of the leakage flux. Therefore, with the arrangement of FIG. 5 ($a_2$) not only prevention of malfunction due to the leakage flux but also prevention of malfunction due to external noises are achieved.

The above-described embodiments of FIGS. 6A, 6B and 7 concurrently satisfies the positional relationships of FIG. 4 ($a_2$) and FIG. 5 ($a_2$). However, an arrangement based on one of the positional relationships of FIG. 4 ($a_2$) and FIG. 5 ($a_2$) may be made providing the effect described in the above.

In the case of the arrangement of FIG. 4 ($a_2$), whether the ignition amplifier 3 malfunctions or not depends on the magnitude of the noise voltage, and therefore, if the noise voltage is low, the ignition amplifier 3 can endure the noise voltage. Therefore, in some cases, the plane parallel to the magnetic sensitive direction of the pickup coil 21 does not necessarily have to be perpendicular to the main flux axis (A) of the ignition coil 4, for instance the angle therebetween may be 80 degrees or so, to obtain substantially the same result. It is also apparent that there is a possibility of obtaining a desirable effect without exactly arranging the pickup coil 21 at the midway point along the external magnetic path of the ignition coil 4.

Although the description of the above embodiment is made in connection with an electromagnetic pickup, of course the invention is applicable to other arrangements in which the rotation signal generating means is constructed by using a Hall element utilizing Hall effect, or magnetic reluctance element, without being limited by the above example.

The above-described embodiment of the present invention is just an example, and therefore, it will be apparent for those skilled in the art that many modifications and variations may be made without departing from the spirit of the invention.

What is claimed is:

1. A distributor assembly having an ignition coil, therein for an ignition system of an engine comprising:
   (a) a distributor body having a distributor housing and a cap attached to said distributor housing;
   (b) a rotary shaft disposed in said distributor body adapted to be rotated in synchronism with the rotation of a crankshaft of said engine;
   (c) a signal rotor, attached to said rotary shaft, having gear teeth-like projections about its circumference;
   (d) rotation signal generating means disposed inside said distributor body, facing said projections of said signal rotor, for providing an output signal by detecting the variation in magnetic flux caused by the rotation of said signal rotor, and having its magnetic sensitive direction aligned in the radial direction of said signal rotor when said signal rotor rotates;
   (e) an ignition coil having primary and secondary windings wound around a core, energization of said primary winding being controlled in accordance with said output signal of said rotation signal generating means, said ignition coil being disposed in said distributor body; and
   (f) a distributing mechanism for distributing a high voltage induced in said secondary winding to a plurality of terminals, the number of which equals the number of the cylinders of said engine, a portion of said distributor mechanism being attached to said rotary shaft;

said ignition coil being arranged in such a manner than a plane perpendicular to the longitudinal axis of the main magnetic flux generated by the energization of said primary winding is substantially parallel to said magnetic sensitive direction of said rotation signal generating means, and said axis is parallel to said rotary shaft; and said rotation signal generating means being arranged at a substantially midway point of an external magnetic path of a magnetic flux passing through said longitudinal axis of said main magnetic flux within said core of said ignition coil.

2. A distributor assembly having an ignition coil therein for an ignition system for an engine, comprising:
   (a) a distributor body having a distributor housing and a cap attached to said distributor housing;
   (b) a rotary shaft disposed in said distributor body adapted to be rotated in synchronism with the rotation of a crankshaft of said engine;
   (c) a signal rotor, attached to said rotary shaft, having gear teeth-like projections about its circumference;
   (d) rotation signal generating means disposed inside said distributor body and facing said projections of said signal rotor, for emitting an output signal by detecting the variation in magnetic flux caused by the rotation of said signal rotor, said means having its magnetic sensitive direction in the radial direction of said signal rotor when said signal rotor rotates;
   (e) an ignition coil having primary and secondary windings wound around a core, energization of said primary winding being controlled in accordance with said output signal of said rotation signal generating means, said ignition coil being disposed in said distributor body; and (f) a distributing mechanism for distributing a high voltage induced in said secondary winding to a plurality of terminals, the number of which equals the number of the cylinders of said engine, a portion of said distribution mechanism being attached to said rotary shaft;

said ignition coil being arranged in such a manner that the longitudinal axis of said main magnetic flux generated by the energization of said primary winding is substantially parallel to said rotary shaft; and said rotation signal generating means being arranged in such a position that said magnetic sensitive direction of said rotation signal generating means intersects a radial line from said longitudinal axis of said main magnetic flux of said ignition coil at an angle other than 90 degrees so that appearance of a leakage flux of said ignition coil acts on said rotation signal generating means enhancing an increasing flux in said rotation signal generating means, which is caused by the rotation of said signal rotor, and disappearance of said leakage flux acts on said rotation signal generating means reducing a decreasing flux in said rotation signal generating means, which is caused by the rotation of said signal rotor.

3. A distributor assembly having an ignition coil therein, comprising:

(a) a distributor body having a distributor housing and a cap attached to said distributor housing;

(b) a rotary shaft disposed in said distributor body to rotate in synchronism with the rotation of an engine crankshaft;

(c) a signal rotor, attached to said rotary shaft, having gear teeth-like projections about its circumference;

(d) rotation signal generating means disposed inside said distributor body, facing said projections of said signal rotor, to emit an output signal by detecting the variation in magnetic flux caused by the rotation of said signal rotor, said means having its magnetic sensitive direction in the radial direction of said signal rotor when said signal rotor rotates;

(e) An ignition coil having primary and secondary windings wound around a core, energization of said primary winding being controlled in accordance with said output signal of said rotation signal generating means, said ignition coil being disposed in said distributor body; and (f) a distributing mechanism for distributing a high voltage induced in said secondary winding to a plurality of terminals the number of which equals the number of the cylinders of said engine, a portion of said distributor mechanism being attached to said rotary shaft;

said ignition coil being arranged in such a manner that a plane perpendicular to the longitudinal axis of the main magnetic flux generated by the energization of said primary winding is substantially parallel to said magnetic sensitive direction of said rotation signal generating means, and said axis is parallel to said rotary shaft; and said rotation signal generating means being arranged at a substantially midway point of an external magnetic path of a magnetic flux passing through said longitudinal axis of said main magnetic flux within said core of said ignition coil; and said rotation signal generating means being arranged in said position that said magnetic sensitive direction of said rotation signal generating means intersects a radial line from said axis of said magnetic flux of said ignition coil at an angle other than 90 degrees so that appearance of a leakage flux of said ignition coil acts on said rotation signal generating means enhancing an increasing flux in said rotation signal generating means, which is caused by the rotation of said signal rotor, and disappearance of said leakage flux acts on said rotation signal generating means reducing a decreasing flux in said rotation signal generating means, which is caused by the rotation of said signal rotor.

4. A distrubutor assembly as claimed in any one of claims 1 to 3, wherein said rotation signal generating means comprises an electromagnetic pickup.

5. A distributor assembly as claimed in claim 4, wherein said electromagnetic pickup comprises a permanent magnet and a coil combined with said permanent magnet.

6. A distributor assembly as claimed in any one of claims 1 to 3, wherein said core of said ignition coil comprises two E-shaped iron cores arranged to constitute a closed magnetic path.

7. A distributor assembly as claimed in any one of claims 1 to 3, wherein said signal rotor comprises a plurality of projections, the number of which equals the number of the cylinders of said engine.

8. A distributor assembly as claimed in any one of claims 1 to 3, wherein said ignition coil is disposed at one side in said distributor body, and said distributor is mounted on said engine at the other side.

9. A distributor assembly as claimed in any one of claims 1 to 3, further comprising an ignition amplifier responsive to said output signal of said rotation signal generating means for controlling the energization of said primary winding of said ignition coil.

10. A distributor assembly as claimed in any one of claims 1 to 3, further comprising a centrifugal advance mechanism.

11. A distributor assembly as claimed in any one of claims 1 to 3, further comprising a vacuum advance mechanism operatively coupled to the intake manifold of said engine.

12. A distributor assembly as claimed in claim 11, wherein said rotation signal generating means is operatively connected to said vacuum advance mechanism so as to be rotated about said rotary shaft in accordance with a degree of vacuum of said intake manifold.

* * * * *